United States Patent [19]

Tonrey

[11] 4,280,621

[45] * Jul. 28, 1981

[54] LAMINAR CHILD RESISTANT PACKAGE

[76] Inventor: John F. Tonrey, 22 Half Turn Rd., Levittown, Pa. 19056

[ * ] Notice: The portion of the term of this patent subsequent to Jan. 8, 1997, has been disclaimed.

[21] Appl. No.: 76,239

[22] Filed: Sep. 17, 1979

Related U.S. Application Data

[63] Continuation-in-part of Ser. No. 920,471, Jun. 29, 1978, Pat. No. 4,196,809.

[51] Int. Cl.[3] ..... B65D 73/00; B65D 83/04

[52] U.S. Cl. ..... 206/534; 206/464; 206/484; 206/459; 206/813

[58] Field of Search ..... 206/484, 484.2, 532, 206/820, 459, 813, 462, 484.1, 534

[56] References Cited

U.S. PATENT DOCUMENTS

| | | | |
|---|---|---|---|
| 3,630,346 | 12/1971 | Burnside | 206/484 |
| 3,913,734 | 10/1975 | Siegel | 206/484 |
| 3,921,805 | 11/1975 | Compere | 206/532 |
| 3,924,746 | 12/1975 | Haines | 206/532 |
| 4,055,672 | 10/1977 | Hirsch et al. | 206/484 |
| 4,196,809 | 4/1980 | Tonrey | 206/534 |

*Primary Examiner*—Joseph Man-Fu Moy
*Attorney, Agent, or Firm*—Robert K. Youtie

[57] ABSTRACT

A laminar child resistant package including foldable layers peelably secured together in facing relation, and fold indicia marking a fold location to effect relief of the adhesive securement between layers.

8 Claims, 8 Drawing Figures

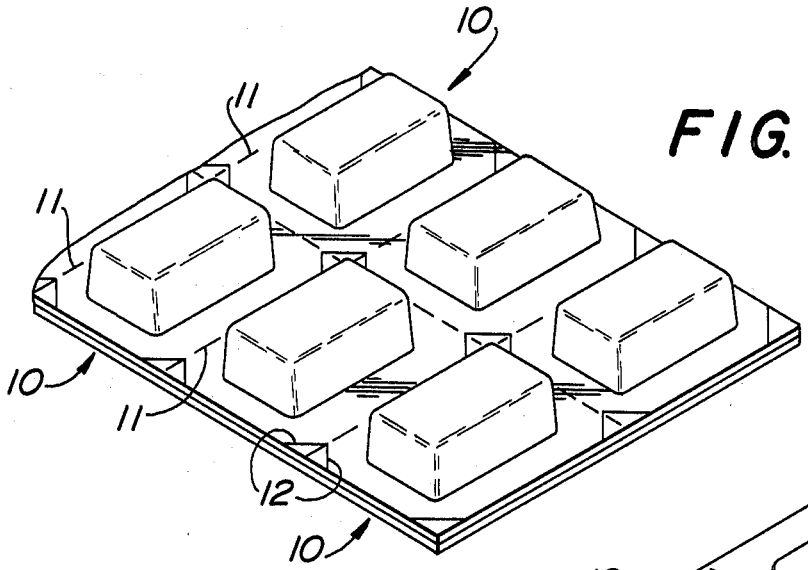
FIG. 1
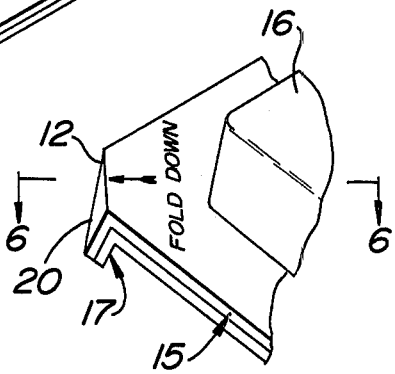
FIG. 2
FIG. 3
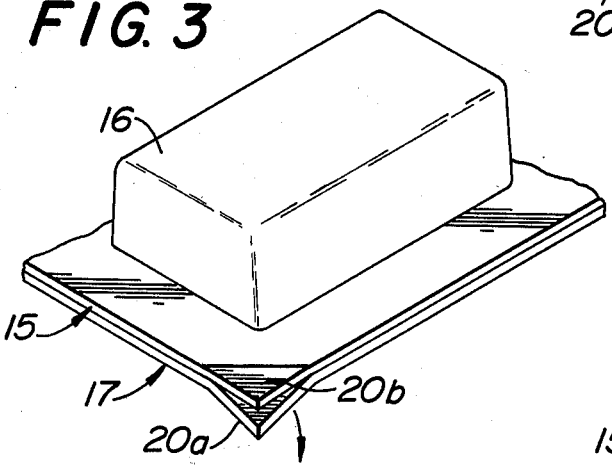
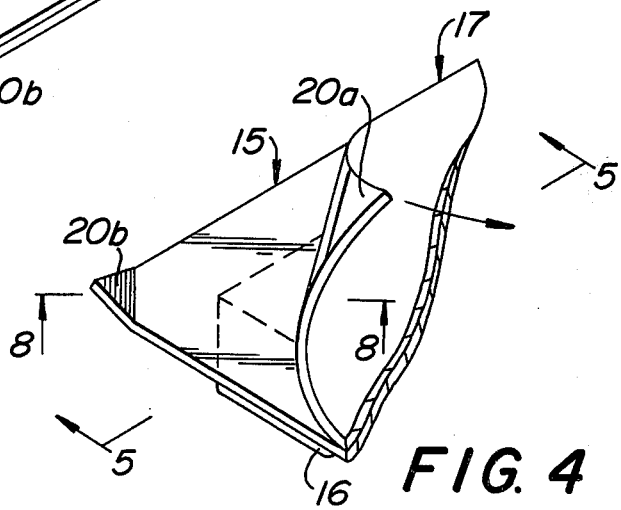
FIG. 4

FIG. 5
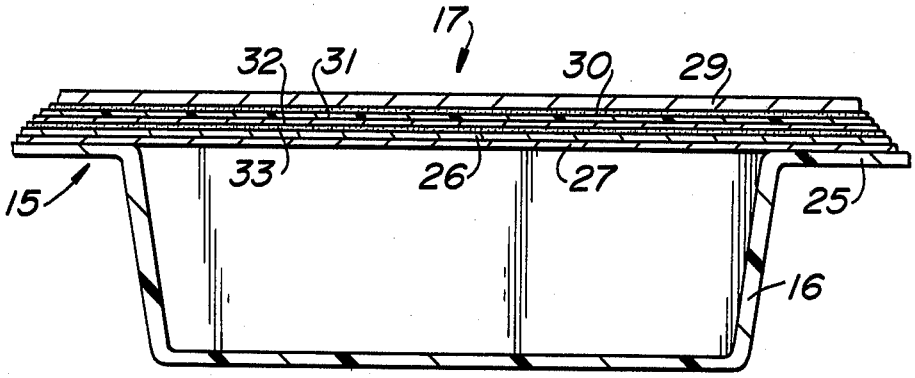
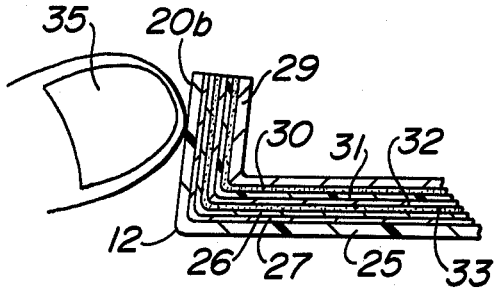
FIG. 6
FIG. 7
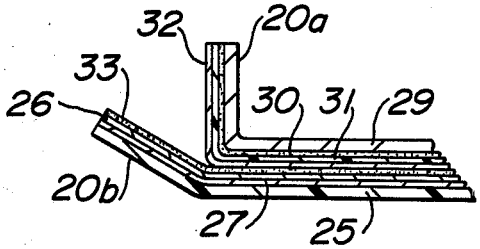
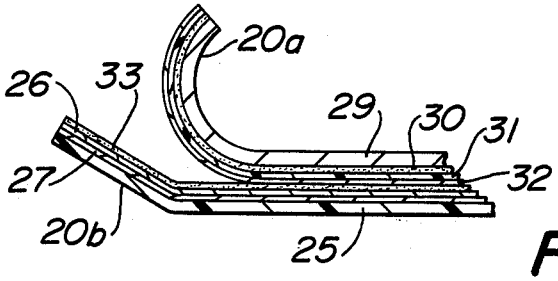
FIG. 8

LAMINAR CHILD RESISTANT PACKAGE

CROSS REFERENCES TO RELATED APPLICATIONS

This application is a continuation-in-part of copending application Ser. No. 920,471, filed June 29, 1978, now U.S. Pat. No. 4,196,809.

BACKGROUND OF THE INVENTION

There has, in the recent past, been considerable activity in the development of what is known in the trade as "child resistant packaging," which permits opening by adults without undue difficulty, as by following printed instructions, and presents substantial obstacles to being opened by children incapable of comprehending and following the necessary instructions. However, such child resistant packaging has, in the past, not been entirely satisfactory as being too difficult or too easy to open, and usually presenting at least some apparent entry structure, which may defeat the intended purposes.

SUMMARY OF THE INVENTION

In accordance with the objects of the present invention it is intended to provide a child resistant package which overcomes the above-mentioned difficulties of the prior art, being quite simple to open by all adults capable of following simple instructions, and affording no apparent entry structure by which children may, through initial attraction thereto and subsequent working thereof, obtain entry to the package contents.

It is another object of the present invention to provide a laminar child resistant package having the advantageous characteristics mentioned in the preceding paragraph, which adds little or no extra cost to manufacture, but on the contrary may produce substantial savings by minimizing material requirements.

It is still another object of the present invention to provide a child resistant laminar package of the type described which is adapted for manufacture by conventional packaging machinery, utilizing conventional packaging materials, and capable of presenting neat and aesthetically attractive packages.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a top perspective view showing a child resistant package constructed in accordance with the teachings of the present invention, partly broken away to conserve drawing space.

FIG. 2 is an inverted partial perspective view showing a package of FIG. 1 in an initial stage of opening.

FIG. 3 is a top perspective view similar to FIG. 1, but illustrating the opening procedure at a slighter later stage than shown in FIG. 2.

FIG. 4 is a perspective view similar to FIG. 3, but inverted and illustrating still a later stage in the opening procedure.

FIG. 5 is an enlarged sectional view taken generally along the line 5—5 of FIG. 4, illustrating one possible laminar structure in accordance with the teachings of the present invention, the scale thereof being necessarily distorted in order to show the relatively thin laminae.

FIG. 6 is a sectional view, also enlarged, taken generally along the line 6—6 of FIG. 2.

FIG. 7 is a sectional view, also enlarged, at a slighter later stage than shown in FIG. 6.

FIG. 8 is a sectional view, also enlarged, taken generally along the line 8—8 of FIG. 4.

DESCRIPTION OF THE PREFERRED EMBODIMENT

Referring now more particularly to the drawings, and specifically to FIG. 1 thereof, a multiple package of the present invention is there illustrated, each individual package being generally designated 10, and being connected to adjacent packages by perforate severance lines 11. Thus, each package 10 may be of a laminar construction, say of the blister type and provided with indicia, such as lines 12, and suitable instructions for directing folds along the markings or lines 12. Such directions may be seen in FIG. 2.

In FIGS. 1–4, there is seen to be a primary layer 15, which may be vinyl or other suitable plastic, which may be formed with a contents holding formation or blister 16. The layer 15 may be hereinafter referred to as the blister layer.

Secured in facing relation therewith is an auxiliary layer, generally designated 17, also foldable and in adherent relation with the layer 15, but shearable and peelable therefrom.

The primary, foldable blister layer 15 may be fabricated of vinyl, or other suitable thermoformable and form retaining sheet material. Additionally, the auxiliary layer 17 secured in facing relation with the primary layer 15 is usually of relatively flexible and relatively inelastic character, say including a lamina of paper, paper board or card stock. As noted hereinbefore, the primary and auxiliary layers 15 and 17 are peelably and shearably adhered together, as by adhesive means which will be hereinafter more fully described, permitting of deliberate separation of the layers. More particularly, after severance along severance lines 11 to remove a single package 10, the composite laminar structure of adherent layers 15 and 17 is folded along a line 12 in accordance with instructions, as shown in FIG. 2. That is, an outer portion 20 of the laminar structure 15, 17 is folded relative to the remainder of the laminar structure along a line 12.

It will there be seen that the primary layer 15 is folded along the line 12 exteriorly about the fold of the auxiliary layer 17. As the outer layer 15 is stressed in distention about the fold 12, by the thickness of the inner layer 17, there will be a substantial shear force applied between the layers 17 and 15 of the folded portion 20. The adherence between layers 17 and 15, as by suitably selected adhesive means, is such as to release the folded portion of layer 17, designated **20*a* from the folded portion of layer 15, designated 20*b*, see FIG. 3. That is, the folded portions 20*a* and 20*b* are released from their adhesive securement, and the portion 20*a* of auxiliary layer 17 will swing away from the portion 20*b* of primary layer 15, so that the unsecured portion 20*a* defines a grasping tab for effecting a peeling separation of the layers 15 and 17, as seen in FIG. 4. Of course, the area or size of folded portion 20 is sufficiently small to insure shearing separation of the layers 15 and 17**.

There are shown in FIGS. 5–8 further details of construction of one embodiment of the present invention. For example, it will there be seen that the primary layer 15 may include a vinyl sheet or lamina 25 and a moisture impervious barrier sheet 26 adhesively secured to the vinyl or blister sheet, as by a heat sealable coating 27.

The auxiliary layer 17 may be of substantial thickness and include a paper sheet, card or paper board 29 which is secured by adhesive 30 to a polyester lamina 31. Interposed in full coverage between the relatively thin polyester lamina 31 and an adhesive layer 33 on foil 26 is a completely covering layer of release agent, for example white printing ink 32. The foregoing lamination may be produced on conventional machinery without appreciable extra cost.

It is, of course, understood that the relative thicknesses of the several laminae are not to scale, but certain laminae are enlarged for clarity and understanding within the allowed drawing space.

The early stage of the opening procedure discussed hereinbefore in connection with FIG. 2 is shown in enlarged scale in FIG. 6, wherein a user's thumb 35 is shown in position effecting the desired fold.

Upon removal of the finger or thumb 35, the folded portion 20*a* of auxiliary layer 17 will spring free of the folded blister layer portion 20*b*, having been separated from the latter along the layer of release agent 32. The released portion 20*a* may then be grasped and peeled away from the blister layer, as shown in FIG. 8.

While the embodiment illustrated and described hereinbefore disclosed the use of a specific release agent white ink 32 to effect release between folded portions 20*a* and 20*b*, it is appreciated that other releasable adhesive means may be employed, as desired. Indeed, the term "adhesive" is used herein in its broad sense as encompassing any medium by which facing layers may be adhered.

For example, the release agent may be eliminated, and the applied shear force will effect separation along a layer of weakness, which may be the heat sealable coating 27 for peeling of the foil layer 26 away from the blister layer 15 together with the auxiliary layer 17. Of course, other combinations and arrangements of laminae may be employed in practice of the instant invention, as set forth in the following claims.

From the foregoing, it is seen that the present invention provides a laminar child resistant package which is extremely simple in construction, so as to minimize production costs and effect substantial savings over other child resistant packages, while providing exemplary resistance to opening by children as affording no apparent entry structure by which children may initiate an opening.

Although the present invention has been described in some detail by way of illustration and example for purposes of clarity of understanding, it is understood that certain changes and modifications may be made within the spirit of the invention.

Although the preferred method of initial entry may be by folding a corner of the package toward the blister, the similar folding of any edge portion of such a package, be the package of any desired outline configuration, will provide satisfactory results.

What is claimed is:

1. In a laminar child resistant package comprising a foldable blister layer, a foldable auxiliary layer of substantial thickness and in facing relation with said blister layer, releasable adhesive means securing said layers together in facing relation throughout an entire area, and fold indicia associated with said layers indicating folding of said layers across said area and toward said auxiliary layer, to extend the blister layer about the fold of the auxiliary layer and place said adhesive means in shear, said adhesive means being sufficiently weak to release in shear upon the folding of said layers toward said auxiliary layer causing the layers to separate apart.

2. A package according to claim 1, said blister layer comprising a plastic sheet, and said auxiliary layer comprising a paper board sheet for flexure about a fold of said auxiliary layer.

3. A package according to claim 1, said adhesive means including a release agent to facilitate release and peelability.

4. A package according to claim 3, said release agent comprising white ink.

5. A package according to claim 1, in combination with a release agent interposed between said auxiliary layer and adhesive to facilitate said release.

6. A package according to claim 1, said auxiliary layer comprising a polyester lamina.

7. A package according to claim 1, said layers being generally congruent, said adhesive means being interposed between said layers substantially entirely about the peripheral edges thereof, said area being contiguous to said peripheral edges, and said fold indicia extending between and terminating at opposite ends at said peripheral edges, causing the layers to separate in the region bounded by said fold indicia and said peripheral edges to define thereof a tab.

8. A package according to claim 7, said layers each being substantially continuous.

* * * * *